US006037867A

United States Patent [19]

Joseph et al.

[11] Patent Number: 6,037,867

[45] Date of Patent: Mar. 14, 2000

[54] PLUG-IN TYPE SUPERVISORY SWITCH

[75] Inventors: Rony K. Joseph, West Lafayette, Ind.; Scott E. Robillard, Aurora, Ill.

[73] Assignee: Pittway Corporation, Chicago, Ill.

[21] Appl. No.: 09/012,158

[22] Filed: Jan. 22, 1998

Related U.S. Application Data

[63] Continuation-in-part of application No. 08/778,447, Jan. 3, 1997.

[51] Int. Cl.[7] ..... G08B 29/00

[52] U.S. Cl. ..... 340/508; 340/548; 340/568.4; 340/687; 340/686.4; 340/686.1; 200/61.93; 200/51.1

[58] Field of Search ..... 340/506, 545.1, 340/548, 545.4, 549, 545.5, 545.6, 568.1, 568.2, 686.1, 687, 686.3, 686.4, 568.3, 568.4, 572.3, 572.8, 686.2, 296; 200/61.93, 51.1

[56] References Cited

U.S. PATENT DOCUMENTS

| | | | |
|---|---|---|---|
| 3,253,270 | 5/1966 | Downer | 340/508 |
| 3,444,547 | 5/1969 | Surek | 340/508 |
| 3,972,039 | 7/1976 | Marshall | 340/508 |
| 3,986,103 | 10/1976 | Frankenberg et al. | 361/102 |
| 4,003,048 | 1/1977 | Weise | 340/568.4 |
| 4,118,691 | 10/1978 | Sims | 222/3 |
| 4,234,879 | 11/1980 | Baker | 340/686.3 |
| 4,418,336 | 11/1983 | Taylor | 340/571 |
| 4,536,754 | 8/1985 | Holce et al. | 340/568.2 |
| 4,840,577 | 6/1989 | Prouty | 439/373 |
| 4,967,792 | 11/1990 | Magee | 137/552 |
| 5,031,660 | 7/1991 | Magee | 137/554 |
| 5,202,673 | 4/1993 | Conrad | 340/524 |
| 5,250,927 | 10/1993 | Nevels | 340/545 |
| 5,525,965 | 6/1996 | Liebenthal | 340/568.3 |
| 5,561,417 | 10/1996 | Rothbaum et al. | 340/568.2 |

*Primary Examiner*—Edward Lefkowitz
*Assistant Examiner*—Daryl Pope
*Attorney, Agent, or Firm*—Rockey, Milnamow & Katz, Ltd.

[57] ABSTRACT

A device for supervising movable articles or objects has a supervising member which can be attached thereto. The device includes a connector disposed in a housing. The housing includes an aperture and a rotary blocking member positionable between the connector and the aperture of the housing. The supervising member is coupled to the connector. The blocking member prevents the supervising member from being recoupled to the connector after it has been removed from the housing. An alarm system is also provided. The alarm system includes ambient condition detectors in communication with a control unit.

43 Claims, 7 Drawing Sheets

PLUG-IN TYPE SUPERVISORY SWITCH

This application is a continuation-in-part of U.S. Ser. No. 08/778,447, filed Jan. 3, 1997.

FIELD OF THE INVENTION

The present invention relates to detection and alarm systems. More particularly, it relates to an apparatus for supervising movable articles or objects, such as control valves and other movable items.

BACKGROUND OF THE INVENTION

In many instances, it is desirable to supervise or detect movement of objects or articles from their proper location. For example, sprinkler systems have been installed in many public and private buildings to help control fires from spreading. These sprinkler systems usually have control valves located in a number of easily accessible areas and may be opened or closed by passing individuals. As a result, these control valves are vulnerable to tampering by unauthorized personnel or may be inadvertently closed. Hence, the sprinkler system may not operate properly allowing a fire which might otherwise be easily contained to spread beyond control. Thus, it is desirable to monitor the status of such valves.

Prior art devices have been developed to initiate an alarm when a sprinkler system control valve is closed. A known device can be used to monitor a handwheel-type valve of a sprinkler system. The device is mounted by a mounting bracket to a structural member adjacent to the handwheel to be supervised. The device has a conventional male plug with two flat, parallel prong-type contacts that are insertable into a freely movable receptacle in a closed housing.

An alarm is activated when the handwheel of the sprinkler system is turned disconnecting the plug from the receptacle. When installing the device, the installer cuts a conductor to the appropriate length and loops the conductor around the handle of the valve. The conductor is then attached to the hook-up terminals of the plug.

Known types of such devices are not rated for external installation. In addition, the known devices are rated for Class B-type wiring only.

Accordingly, there is a need for an improved apparatus to supervise movable articles or objects. It would be desirable if the apparatus was easily installed and operated. It would also be desirable if the apparatus was suitable for exterior installation and if it could be wired for Class A operation.

SUMMARY OF THE INVENTION

A supervisory apparatus incorporates at least first and second sets of contacts both sides of which can be continuously monitored. One set of contacts is usable to monitor the position of a movable object, such as a valve handle or a door. Movement of the object causes that set of contacts to change state, resulting in a detectable signal.

The second set of contacts provides another detectable, or trouble, signal. The second set of contacts also changes state in response to movement of the object.

In one embodiment, a flexible cable connects the apparatus to the movable object. Movement of the object disconnects the cable from the apparatus causing the two sets of contacts to change state, If the cable is cut, a change in the signals from the apparatus can be detected thereby identifying this condition.

In one aspect, the apparatus incudes a bracket mountable to a fixed surface. An elastomeric bushing is carried by the bracket and supports a housing.

The bushing enables the orientation of the housing to be adjusted. It also isolates the apparatus from vibrations. In one embodiment, the bushing will be tapered.

The housing carries a connector for the cable. A rotary member blocks insertion of the cable into the connector except when that member is moved to a non-blocking position. The rotary member can be spring biased.

The housing carries a removable cover. A cover tamper switch provides a signal indicative of cover movement. A gasket between the cover and the housing provides a water resistant seal. Hence, the housing can be mounted in wet or exterior locations.

Numerous other advantages and features of the present invention will become readily apparent from the following detailed description of the invention and the embodiments thereof, from the claims and from the accompanying drawings.

DETAILED DESCRIPTION OF THE PREFERRED EMBODIMENTS

Before explaining the present invention in detail, it should be noted that the invention is not limited in its application or use to the details of construction and arrangement of parts illustrated in the accompanying drawings and description, because the illustrative embodiments, variations and modifications, and may be practiced or carried out in various ways. Furthermore, the terms and expressions employed herein have been chosen for the purpose of describing the illustrative embodiments of the present invention for the convenience of the reader and are not for the purpose of limitation.

Figure 1:
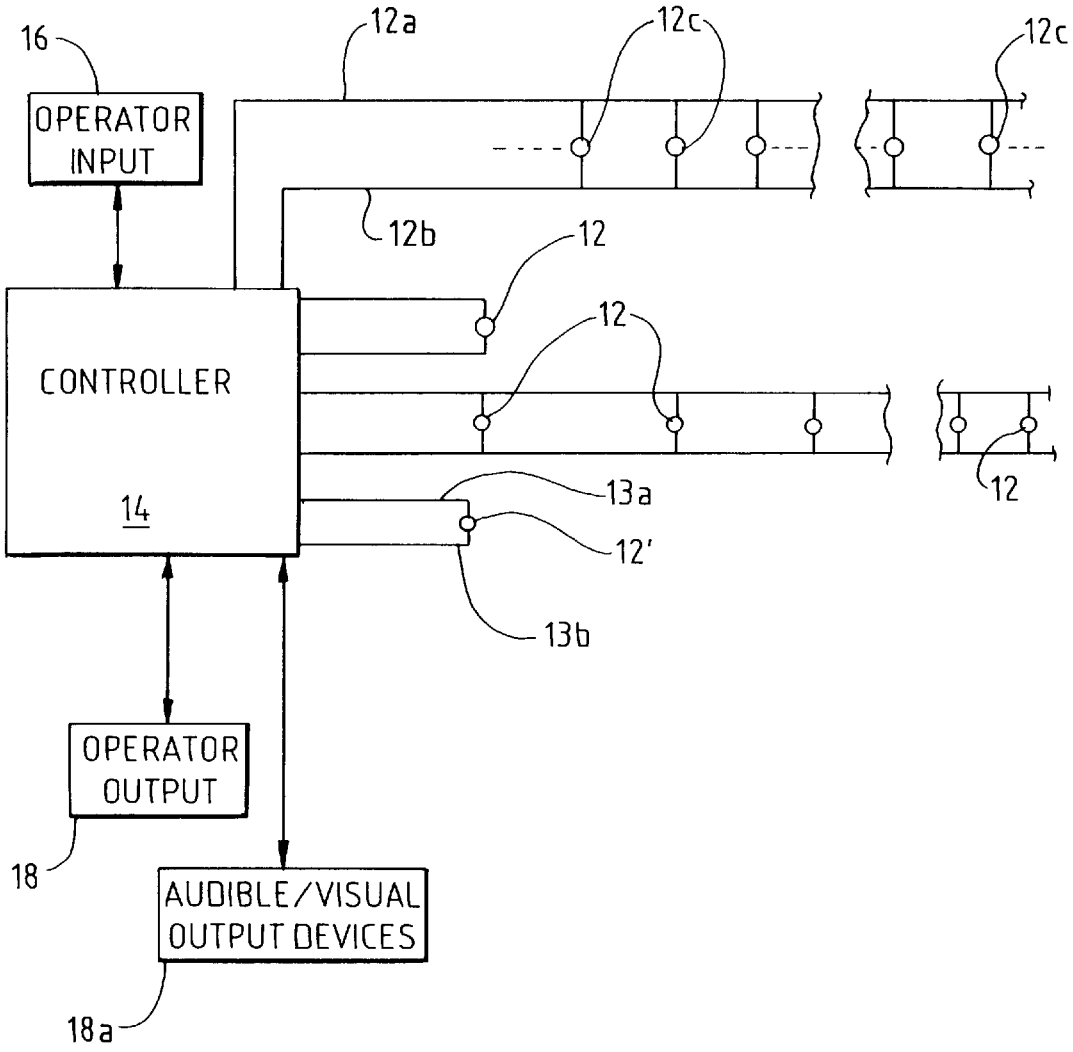
FIG. 1 is a schematic drawing of an alarm system in accordance with the present invention.

Referring now to the drawings, and more particularly to FIG. 1, the reference number 10 designates an exemplary embodiment of an alarm system for monitoring objects or articles in accordance with the present invention. The system 10 detects when an article or object is tampered with or is moved from its proper position so that preventive action may be taken by an operator or authorized personnel. The system 10 can in turn cause an alarm to be activated when the object or article is moved from its desired position.

As shown in FIG. 1, the alarm system 10 includes a plurality of supervisory devices 12, a control unit or controller 14, an operator input device 16, and an operator output device 18. The system 10 may also include a communication link 12*a,b* to which are connected other detection devices 12*c*, such as fire detectors, smoke detectors, thermal detectors, and the like. The system 10 may also include a device 18*a* that can activate strobe lights, audible alarms and the like.

The supervisory devices 12 are in communication with or coupled to the controller 14 in series and/or parallel. For example, device 12' is coupled via conductors 13*a*, 13*b* to the controller 14. The devices 12 are also coupled to an object or article to be monitored or supervised.

When the object is moved or tampered with, the respective supervisory device 12 provides an indication of an alarm situation to the controller 14 and an alarm may be activated. The controller 14 can detect either an open or a closed circuit of the respective device 12.

The controller 14 of the system 10 may include a microprocessor and may also include a storage device, such as read only memory (ROM). The controller 14 may be used to continuously monitor or scan one or more of the supervisory devices 12 or condition detectors 12*c* in any combination at a preselected frequency and duration.

When the controller 14 detects a supervisory condition signal from one or more of the devices 12, an alarm may be activated. Alternatively, a trouble or status message can be displayed on the output device 18. The controller 14 may also identify the particular location(s) or position(s) of the devices 12 in the environment that the respective event detectors are monitoring. In addition to monitoring the status of various movable objects such as valve handles, doors or the like, via devices 12, the system 10 can also generate an alarm condition in the presence of a fire condition that might be sensed by one or more of the detectors 12*c*.

The input device 16 of the detection system 10 is preferably linked or coupled to the controller 14. Preferably, the input device 16 includes a keyboard or a keypad or a plurality of other input types.

The input device 16 may allow a number of versatile control or scanning functions to be utilized. For example, one or more of the devices 12 or condition detectors 12*c* may be selected for continuous monitoring. Alternatively, the frequency and duration of scanning of all or a selected number of devices 12 may be initially preset and/or changed.

The output device 18 of the system 10 is preferably linked or coupled to the controller 14. The output device 18 can include a display or monitoring panel (not shown) that may alert an operator that a trouble or an alarm condition exists. Preferably, the output device 18 will be remotely located from the devices 12.

The output device 18 may include a monitor and/or a plurality of light-emitting diodes showing the location of the devices 12 and other system controls (not shown). The output device 18 may generate a message or an alarm that can be visual, audible, or both when an alarm condition is detected. A print-out of the message can also be created.

The devices 12 may be monitored independently so that a message may be displayed by the output device 18 to identify the detected event and the corrective action required. It is contemplated that the output device 18 may be any suitable device that can indicate an alarm condition to an operator. The alarm condition may be designed at any level of sophistication or complexity in order to indicate that an article or object coupled to an device 12 has been tampered with or moved from its desired position.

Figure 2:
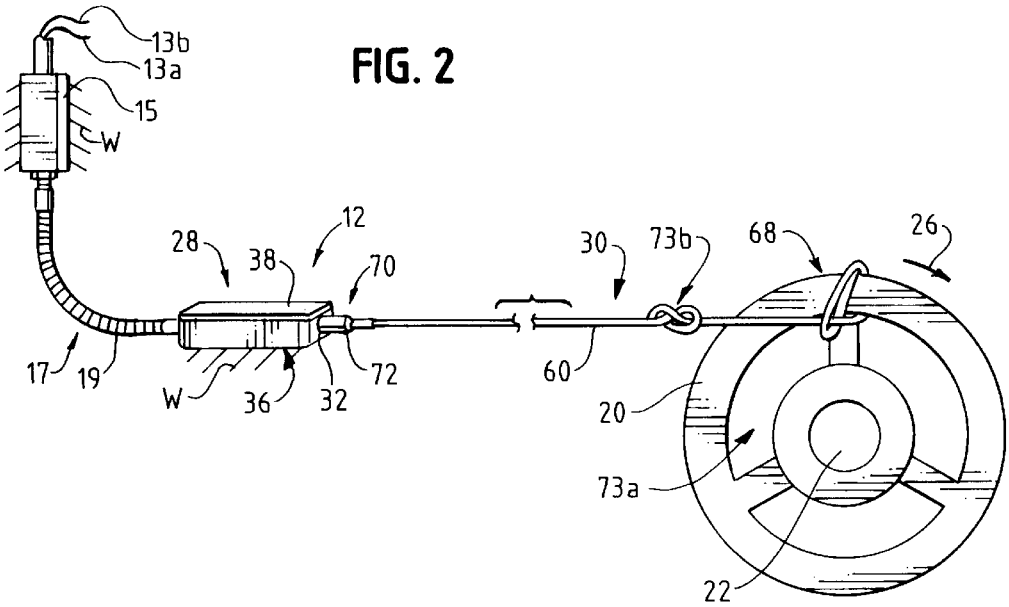
FIG. 2 is a perspective view of an event detector coupled to a handwheel of a valve and an electrical junction box.

Referring now to FIG. 2, one embodiment of a supervisory device 12 is illustrated supervising a handwheel 20 of a valve 22 which could be part of a sprinkler system. The device 12 may be mounted to a wall W adjacent to or near the handwheel 20. The device 12 may be mounted to the wall by any suitable means without departing from the spirit and scope of the invention. The device 12 can but need not be mounted to a mounting bracket (not shown).

As shown in FIG. 2, device 12 is coupled to an electrical junction box 15 by a connecting member 17. The connecting member 17 preferably includes a flexible conduit 19 often made of steel or other types of conduits or cables could be used without departing from the spirit and scope of the present invention.

The flexible conduit 19 carries a plurality of two or more conductors 48, 50 that extend from the electrical junction box 15 to the device 12 to form a closed circuit loop as will be further discussed below. The conductors 48, 50 are also preferably in communication or linked to the controller 14 of the detection system 10 via conductors 13*a,b*.

The flexible conduit 19 of the connecting member 17 provides a flexible mounting arrangement that allows the device 12 to be positioned in a desired relationship with the handwheel 20 of the valve 22. For example, the device 12 may be positioned to detect any movement of the handwheel 20 from a particular position or to detect movement of the handwheel 20 beyond a selected range. The device 12 is preferably positioned so that an alarm will be activated when the handwheel 20 is turned, for example, in the direction of the arrow 26. No special brackets are needed to attach it to the valve 22.

As those skilled in the art will appreciate, the device 12 may be used to detect movement of any object and is not to be limited to the particular applications discussed herein. For example, the device 12 may be utilized to supervise pit valves, non-rising stem gate valves, lever actuators, and other manual actuators as well as supervise any movable object that remains in a normal fixed position for a period of time, such as covers, doors, windows, boxes, cabinets, etc.

The device 12 generally includes a housing 28 and an elongated, flexible supervisory member 30. The housing 28 includes a cover 38, a front panel 32, and a bottom panel 36.

The housing 28, as illustrated, has a rectangular configuration and is constructed from aluminum. As those skilled in the art will recognize, the size and shape of the housing 28 may be any suitable configuration and the housing 28 may be made from a variety of materials without departing from the spirit and scope of the invention.

Figure 3:
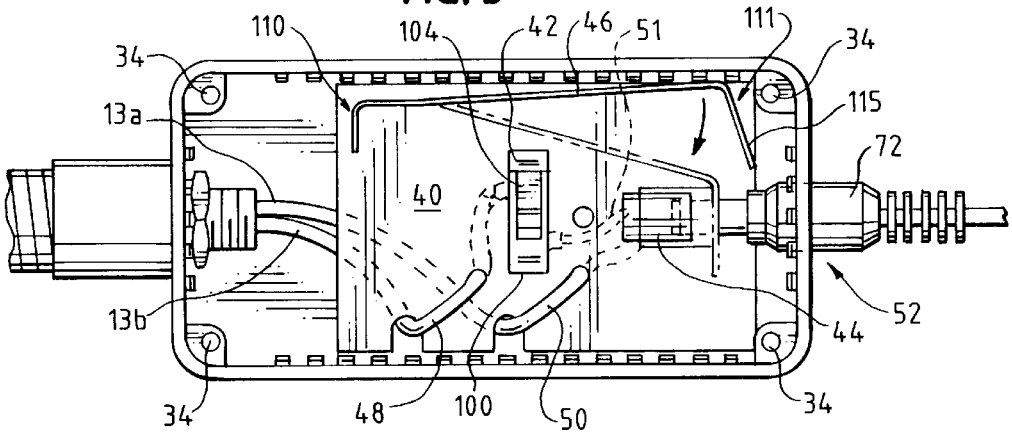
FIG. 3 is a top view of an embodiment of the interior of a housing of the event detector of FIG. 2.

The cover 38 is detachably coupled to the housing 28. The cover 38, as illustrated, is secured at its edges of the housing 28 by screws (not shown). The screws are secured in the threaded bores 34 of the housing 28 as shown in FIG. 3.

It is contemplated the cover 38 may be secured to the housing 28 by any suitable means. The cover 38 may also have a locking mechanism (not shown) to prevent entry by unauthorized personnel.

The cover 38 of the housing 28 allows an installer or system maintenance worker to gain access to the interior of the housing 28 to attach the supervisory member 30 to a receptacle or socket 44 fixedly carried in the housing 28. The cover 38 is preferably electrically monitored so that an alarm will be activated whenever the cover 38 is removed or loosened from the housing 28.

A flow of current in lines 13*a*, 13*b* through detector 12' can be monitored in controller 14. Removal of the supervisory member 30 from receptacle 44 interrupts this current thereby resulting in a trouble or a maintenance message at the output device 18.

The front panel 32 of the housing 28 preferably has an opening or aperture 52 extending therethrough. The aperture 52 provides a passage through which the supervisory member 30 may be inserted so that it may be coupled to the receptacle 44 enclosed in the housing 28.

Referring still to FIG. 2, the supervisory member 30 of the device 12 generally includes a flexible cable or an insulated conductor loop 60.

Figure 5:
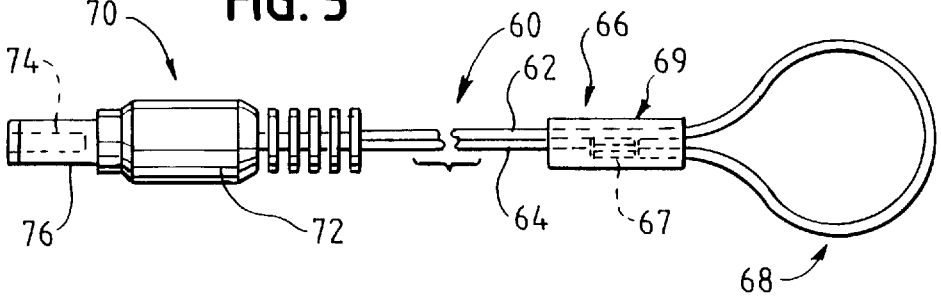
FIG. 5 is an embodiment of a supervisory member.

The cable 60 includes a molded D.C. signal cable as further shown in FIG. 5. The cable 60 preferably has at least two insulated electrical conductors 62, 64 that are spliced and coupled together at a junction 66 providing a continuous circuit loop.

The conductors 62, 64 can be coupled together by a metal ferrule 67. Heat shrink tubing 69 is disposed around the cable 60 and the metal ferrule 67. It is also contemplated that the cable 60 may include a coaxial or other type of cable. Other arrangements can also be used to configure the cable 60.

As shown in FIG. 5, the cable 60 of the supervisory member 30 generally includes a first end 68 and a second end 70. The first end 68 of the cable 60 is preferably fixedly secured to an object or article, such as handwheel 20 of the valve 22 as shown in FIG. 2. The first end 68 has a loop or eyelet 69 than can be utilized to secure the cable 60 to the handwheel 20.

The second end 70 of the cable 60 is intended to be coupled to the housing 28. As illustrated, the second end 70 is inserted through aperture 52 of the front cover 32 into the receptacle 44 disposed in the housing 28. The second end 70 includes a plug 72 that may be removably coupled to the receptacle 44.

The plug 72 includes an inner contact 74 (shown in phantom in FIG. 5) and an outer contact 76. Once the plug 72 is inserted into the receptacle 44, a circuit is established from the outer contact 76 of the plug 72 through the conductors 62, 64 to the inner contact 76 of the plug 72.

To attach the cable 60 to the handwheel 20 of the valve 22, the handwheel 20 is rotated to a desired position and the first end 68 of the cable 60 is coupled to the handwheel 20. The first end 68 of the cable 60 is preferably looped over and around the handwheel 20, and the second end 70 is passed through the loop 69 forming a slip knot arrangement.

The cable 60 may be manufactured in a number of different lengths to allow an installer to easily attach an appropriate length cable 60 that corresponds to the distance between the handwheel 20 and the housing 28 of the device 12. The installer does not need to cut or make a cable.

The length of the cable 60 may also be adjusted by passing the cable 60 around the handwheel as many times as desired to reduce the length of the cable 60. Further, one or more knots 73 may be tied in the cable 60 to shorten the cable 60 as desired.

The cable may also be shortened by splicing the conductors 62, 64 and crimping the shortened conductors into the metal ferrule 67. The heat shrink tube 69 may then be positioned around the metal ferrule 67 to insulate the conductors 62, 64.

After the first end 68 is suitably engaged with the handwheel 20, the second end 70 of the cable 60 is then inserted through the aperture 52 of the housing 28 and into the receptacle 44. The event detector 12 may be aligned so that the cable 60 can be pulled straight out of the housing 28 when the handwheel 20 is turned in the direction of the arrow 26 as shown in FIG. 2.

Once the device 12 has been properly installed, it can be used to supervise the handwheel 20. When the handwheel 20 is turned, the plug 72 of the cable 60 is withdrawn or pulled from the receptacle 44 housing 28 interrupting a supervisory current. This causes an alarm to be activated to notify an operator that the handwheel 20 has been moved or disturbed.

The alarm may be terminated by opening the cover 38 of the housing 28 to re-mate the plug 72 and receptacle 44. The plug 72 cannot be reinserted after it is removed from the receptacle 44 until the cover 38 of the housing 28 is removed.

Figure 4:
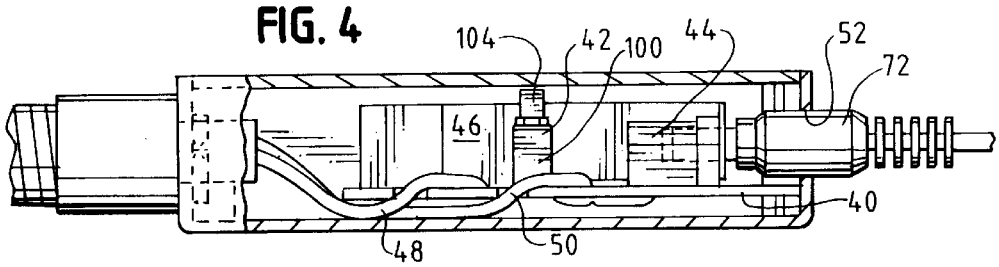
FIG. 4 is a partial cut-away side view of the housing of FIG. 3.

Referring now to FIGS. 3–4, the interior of the housing 28 is shown after the removal of the cover 38. The interior of the housing 28 includes a mounting board 40, a tamper switch 42, a receptacle 44, a lockout member 46, and a plurality of conductors 48, 50, 51. The conductors 13*a*, 13*b* could correspond to conductors 48, 50 where each conductor 48, 50, for example, is a single conductor. Alternatively, one or both may be multiple conductor cables.

The mounting board 40 is preferably a printed circuit board having a plurality of holes (not shown) extending therethrough. The mounting board receptacle 44 is secured to the bottom panel 36 of the housing 28 by a conventional bolt (not shown). It is contemplated that any suitable means may secure the mounting board 40 to the housing 28.

Figure 6:
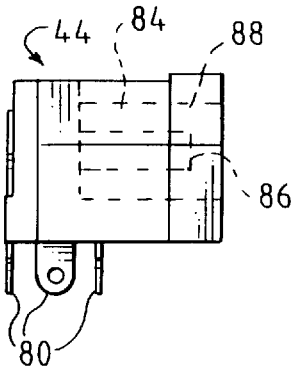
FIG. 6 is a side elevational view of a receptacle.
Figure 7:
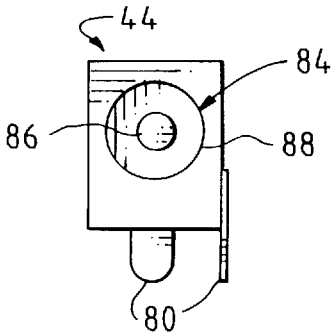
FIG. 7 is a front view of the receptacle of FIG. 6.

The receptacle 44 is fixedly mounted on the mounting board 40. The receptacle 44 preferably has a plurality of leads 80 and an opening 84 as shown in FIGS. 6–7. The opening 84 of the receptacle 44 is preferably aligned with the aperture 52 of the housing 28 so that the plug 72 of the cable 60 can be inserted through the aperture 52 and into the opening 84 of the receptacle 44.

The opening 84 of the receptacle 44 contains an inner contact 86 and outer contact 88. The inner contact 86 of the receptacle 44 is adapted for engagement with the inner contact 74 of the plug 72 and the outer contact 88 of the receptacle 44 is adapted to engage with the outer conductor 76 of the plug 72 to form a closed circuit loop. The leads 80 of the receptacle 44 are connected to the conductors 50, 51 in a manner known in the art via mounting board 40.

Figure 8:
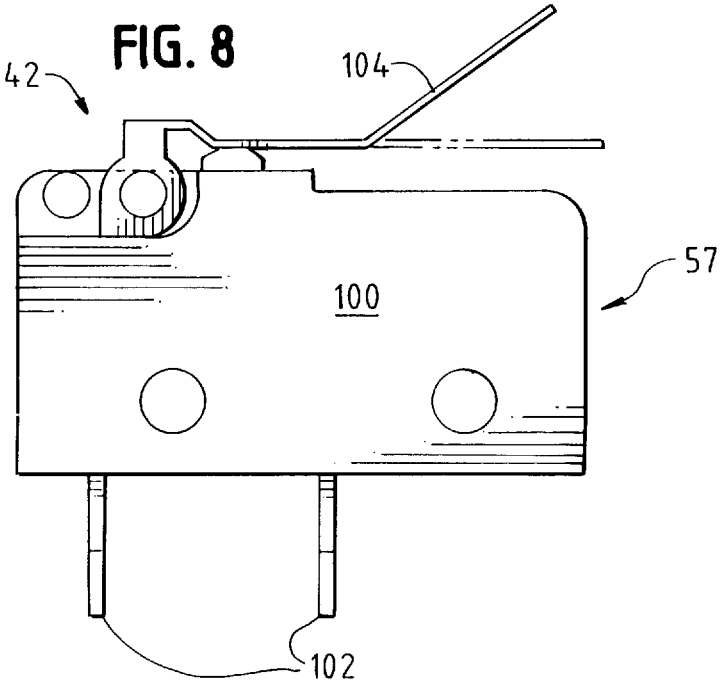
FIG. 8 is a side view of a tamper, switch mechanism.

Referring now to FIG. 8, the cover tamper mechanism 42 as illustrated includes a body 100, a switch 57 (see FIGS. 9–12), a plurality of contacts 102, and a lever 104. Preferably, the tamper mechanism 42 includes a microswitch that is mounted to the mounting board 40 disposed in the housing 28 of the event detector 12. The tamper mechanism 42 may include a magnetic switch or any other suitable switch and may be mounted in other fashions without departing from the spirit and scope of the invention.

Figure 9:
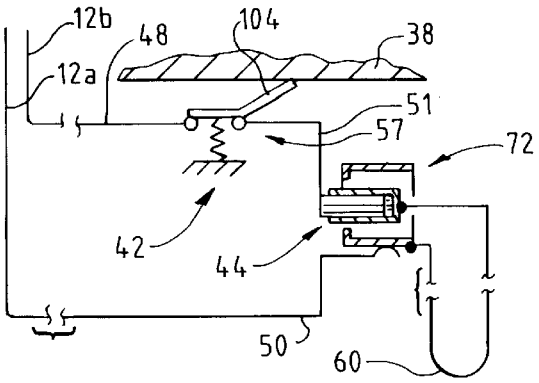
FIG. 9 is a schematic diagram of hardware of the event detector with a cover mounted to a housing and a plug of the supervisory member inserted in a receptacle.
Figure 11:
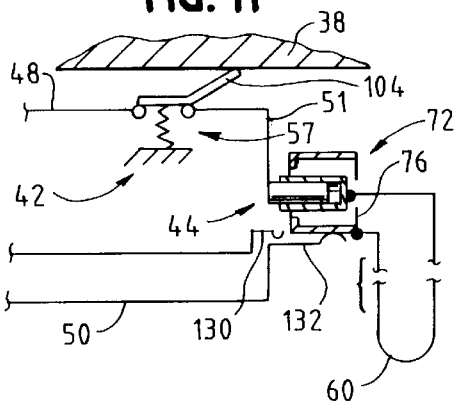
FIG. 11 is a schematic diagram of the circuitry of the event detector with a cover mounted to a housing and a plug inserted in a receptacle.

The lever 104 of the tamper mechanism 42 is preferably biased away from the body 100 so that it extends outwardly from interior of the housing 28. Once the cover 38 is secured to the housing 28, the lever 104 is pushed inwardly to close the switch 57 as shown in FIGS. 9 and 11.

When the cover 38 is loosened or removed from the housing 28, the switch 57 is opened (see FIGS. 10 and 12) and a maintenance or trouble signal may then be initiated to notify an operator or authorized personnel that the event detector 12 is being tampered with.

The plurality of leads 102 of the tamper mechanism 42 are connected to the conductors 48, 51 as known in the art. The tamper mechanism 42 is preferably wired in series with the receptacle 44.

The series combination of the tamper mechanism 42 and the receptacle 44 and the flexible supervisory member 30 provide a normally closed switch circuit. When this circuit is opened, a supervisory current can be interrupted and a trouble or maintenance message can be generated at the output device 18. It is also contemplated that the tamper mechanism 42 and receptacle 44 each may be wired into a separate normally closed or open circuit.

Referring again to FIGS. 3–4, an embodiment of a spring-loaded lockout member 46 is shown. The lockout member 46 has a first end 110 and a second 111. The lockout member 46 may be fabricated from a strip of material, such as spring steel or spring brass. The first end 110 of the lockout member 46 is bent to form a blocking member 115.

When the plug 72 is connected to the receptacle 44, the spring loaded blocking member 115 rests against the outer surface of the plug 72. When the plug 72 is disconnected from the housing 28, the blocking member 115 is moved between the aperture 52 of the housing 28 and the receptacle 44. As a result, the plug 72 may not be reinserted through the aperture 52 of the front panel 32 and reconnected to the receptacle 44. It is also contemplated that a separate spring may also be used to move a blocking member 115 between the aperture 52 and the receptacle 44 when the plug 72 is removed.

Figure 10:
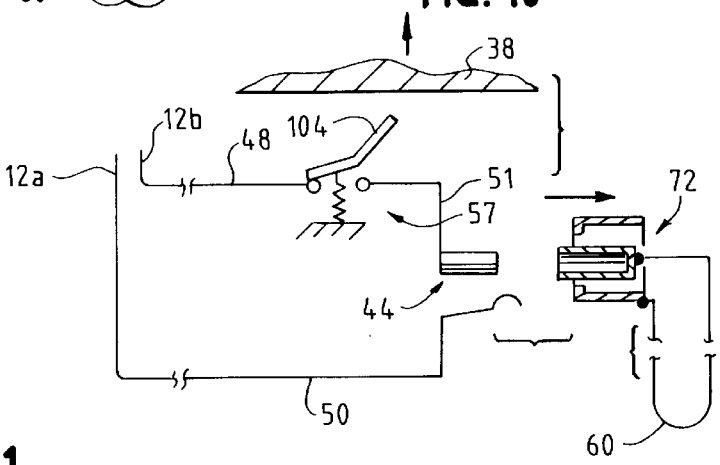
FIG. 10 is a schematic diagram of the circuitry of FIG. 9 with the cover removed from the housing and the plug disconnected from the receptacle.

Referring to FIGS. 9–10, a schematic diagram of the circuitry of the device 12 is shown. The device 12 as illustrated forms a closed switched circuit. As shown in FIG. 9, the cover 38 is attached to the housing 28 to push the lever 104 inwardly to close the switch 57 providing an electrical connection between the conductors 48 and 51. The plug 72 is also inserted into the receptacle 44 to form a continuous circuit between conductors 50 and 51. These can in turn be connected to conductors 12*a*, 12*b*.

When the cover 38 is removed from the housing 28, the switch 57 is opened causing an open circuit as shown in FIG. 10. In addition, when the plug 72 is removed from the receptacle 44, an open circuit occurs between the conductor 50 and 51. An open circuit will also occur if either or both conductors of the cable 60 is cut, broken, or otherwise open-circuited.

When an open circuit occurs, a supervisory current is interrupted and an alarm is activated to notify the operator or authorized personnel that the device 12 is being tampered with or an object or article coupled to that device 12 has been moved. It is contemplated that although the circuitry is shown as a normally closed circuit, the circuitry may be a normally open circuit.

Figure 12:
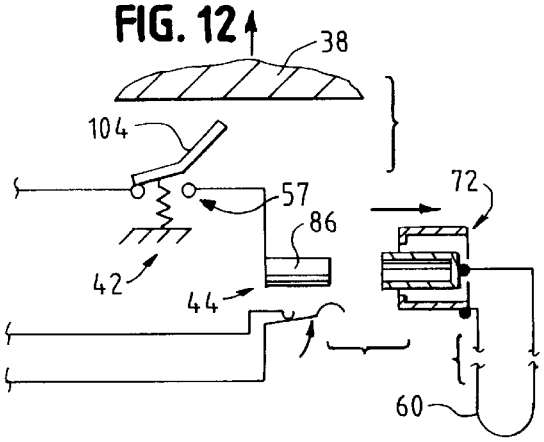
FIG. 12 is a schematic diagram of the circuitry of FIG. 11 with the cover removed from the housing opened and the plug disconnected from the receptacle.

FIGS. 11 and 12 illustrate another schematic diagram of the circuitry of the device 12. In this embodiment, an auxiliary contact 130 of the receptacle 44 may be used.

As shown in FIG. 11, outer contact 76 of the plug 72 is coupled to contact 132 when the plug 72 is inserted into the receptacle 44 forming a closed loop. When the plug 72 is removed from the receptacle 44, the contact 132 closes against the contact 130 closing the circuit therebetween. As a result, the circuit between contacts 132 and the inner contact 86 of the receptacle 44 is opened. These contact openings and closings can also be detected via supervisory currents. As an alternate to currents, supervisory voltages could be used.

Figure 15:
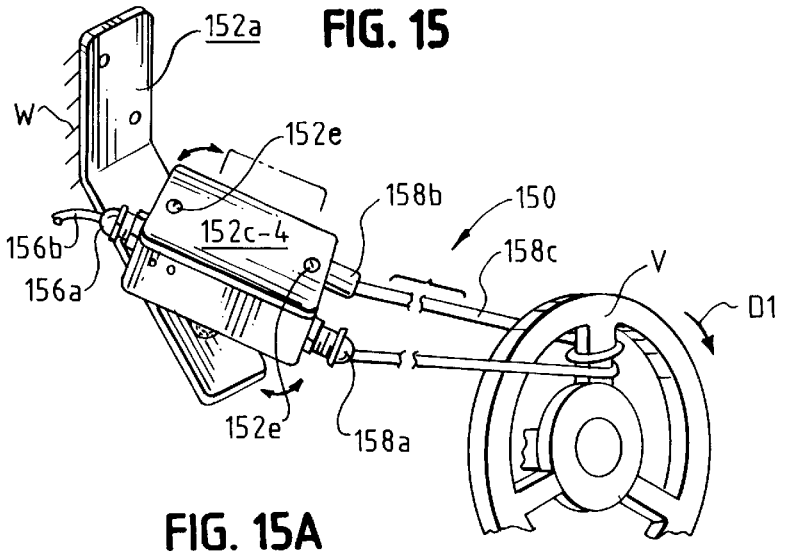
FIG. 15 is a perspective view of the device of FIG. 13 coupled to a valve handle by a conductive supervisory cable.

FIGS. 13 through 15A illustrate an embodiment 150 of the present invention. The embodiment 150 can also be used for purposes of supervising the position of selected movable objects such as valve control handles V as illustrated in FIG. 15.

The device 150 includes a rigid mounting bracket 152*a* which can be attached to a wall of surface W in the vicinity of object such as the valve control handle V whose position is to be monitored. The device 150 also includes an elastomeric, deformable, mounting structure 152*b*.

One end of the mounting structure 152*b* is coupled to the bracket 152*a*. The other end is coupled to a housing 152*c*.

The housing 152*c* defines an interior region 152*d* which is bounded by a bottom 152*c*-1 first and second elongated side walls 152*c*-2 and first and second end walls 152*c*-3. The housing 152*c* is closed by a cover 152*c*-4.

A gasket 152*c*-5 positioned between the housing 152*c* and the cover 152*c*-4 provides a water-resistant seal therebetween. The cover 152*c*-4 can be rigidly attached to the housing 152*c* by high security screws 152*e* which are not readily removed without tools.

Three connectors are associated with the device 150. Connector 156*a* provides a vehicle for coupling electrical conductors to and from a control unit, such as control unit 14 in FIG. 1. It will be understood that an electrical cable 156*b* attached to the connector 156*a* can carry a plurality of electrical conductors depending on a selected wiring configuration, as discussed subsequently.

Two other connectors 158*a* and 158*b* are joined by an electrical cable 158*c*. The cable 158*c* forms a sensing element for detecting the movement of the object, such as the valve control handle V. The connector 158*a* is fixedly attached to an end panel 152*c*-3 of the housing 152*c*. The connector 158*a* can be of a type which permits adjustment of a length parameter of the cable 158*c* at installation.

The second connector 158*b* is removably coupled to the housing 152*c* by a fixed, multiple contact female connector 158*d*. The connector 158*d* is fixedly attached to, for example, the bottom panel 152*c*-1 of the housing 152*c*. The connector 158*b* could be, for example, a commercially available form of an audio plug. The female connector 158*d* could be any commercially available mating socket with auxiliary contacts as described below.

Located adjacent to the connector 158*d* is a biased rotary blocking element 160*a*. The blocking element 160*a* is forced to a blocking position, best seen in FIG. 14, in response to a biasing spring 160*b*.

The biasing spring 160*b* is illustrated as a coil spring. It will be understood that other forms of springs could be used without departing from the spirit and scope of the present invention.

Figures 13, 14:
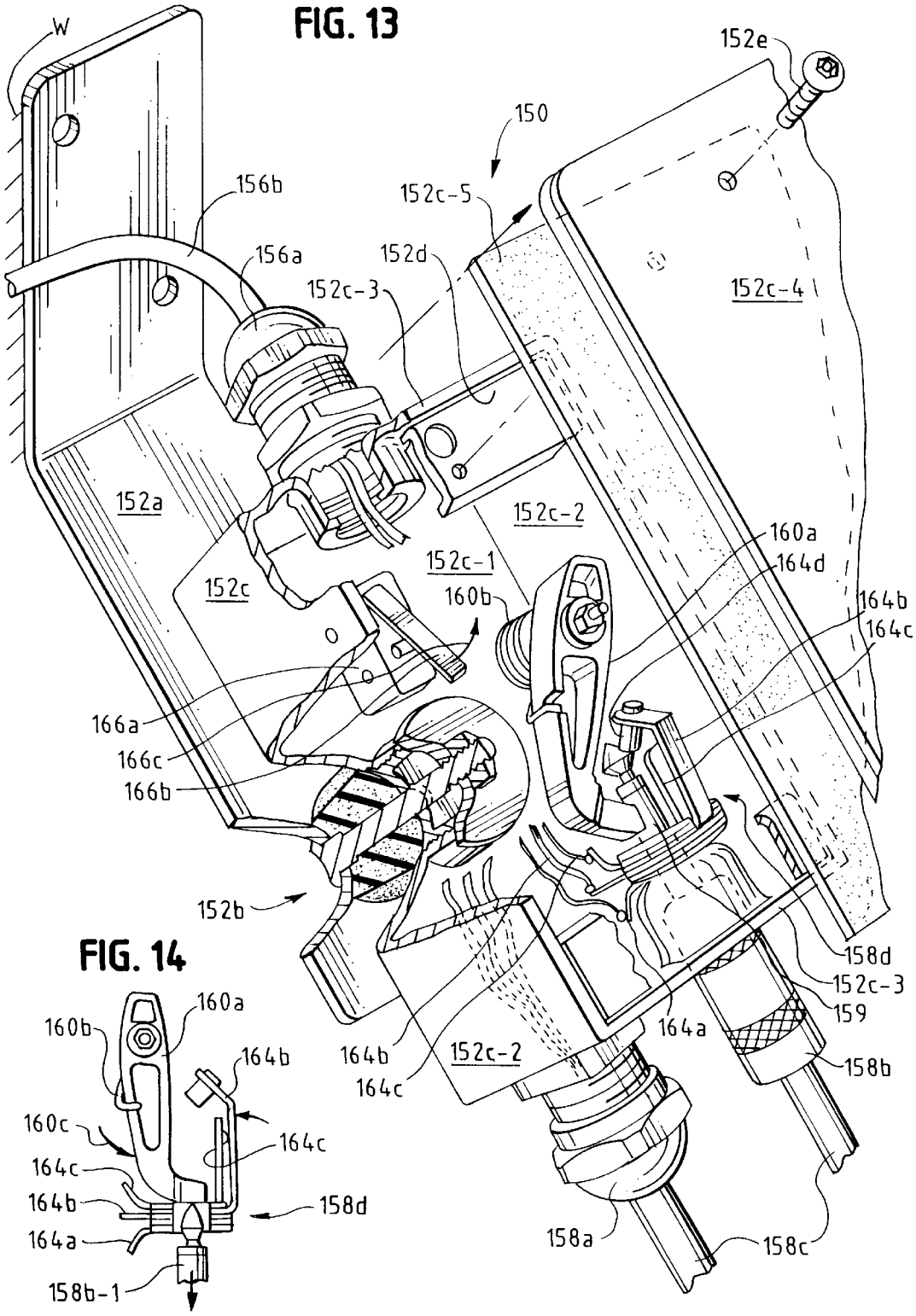
FIG. 13 is an enlarged, perspective view, partly broken away and with the cover removed, of another supervisory device.
FIG. 14 is an enlarged top plan view of the lockout mechanism of FIG. 13.

As illustrated in FIG. 14, when a male conductive portion or plug 159 of connector 158*b* is withdrawn from the connector 158*d*, the blocking member 160*a* rotates in a direction 160*c* to the blocking position. Linear motion could also be used.

When in the blocking position, the male portion 159 of the connector 158*b* cannot be reinserted into the socket of connector 158*d*. Insertion requires that the cover 152*c*-4 be removed from housing 152*c* and that the rotary blocking element 160*a* be moved in a direction opposite 160*c* away from the blocking position illustrated FIG. 14. In such an instance, the elongated male element 159 can be reinserted into the connector 158*d*, illustrated in FIG. 13.

As described above, removal of the male connector 158*b* from the female connector 158*d* produces a condition wherein the male connector cannot be reinserted into the female connector without opening the housing 152*c*. Hence, as valve handle V is rotated in a first direction D1, which might correspond to closing the valve, the cable 158*c* attached to the male connector 158*d* will pull the connector from the housing 152*c*.

Removal of the connector 158*b* will produce a detectable change in an electrical signal on the cable 156*b*. This change can be detected at the control element 14. Appropriate messages or alarms can then be generated at the operator output device 18. These could include visual or audible indicators of an alarm or trouble condition.

The female connector element 158*d* carries a contact element 164*a* which is in electrical contact with the male conductive element 159 when that element is inserted into the female connector 158*d*. The connector 158*d* also carries first and second normally closed contacts 164*b* and 164*c*.

The contacts 164*b* and 164*c*, while normally closed, are held in an open state by the male conductive element 158*b*-1. That element is electrically isolated from the contacts 164*b, c* by an insulator 164*d*.

Hence, the process of inserting the male connector 158*b* into the female connector 158*d* results in an open circuit between contacts 164*b, c* and a closed circuit between the male conductive element 158*b*-1 and contact 164*a* of the connector 158*d*.

The presence or the absence of the cover 152*c*-4 on the housing 152*c* can be detected by the state of a sensor. As illustrated in FIG. 13, a preferred sensor is a spring-biased switch 166*a*. The switch 166*a* has a biased sensing lever 166*b* which signals removal of the cover 152*c*-4 by moving in a direction 166*c* thereupon causing contact with the switch 166*a* to change state.

Figure 15A:
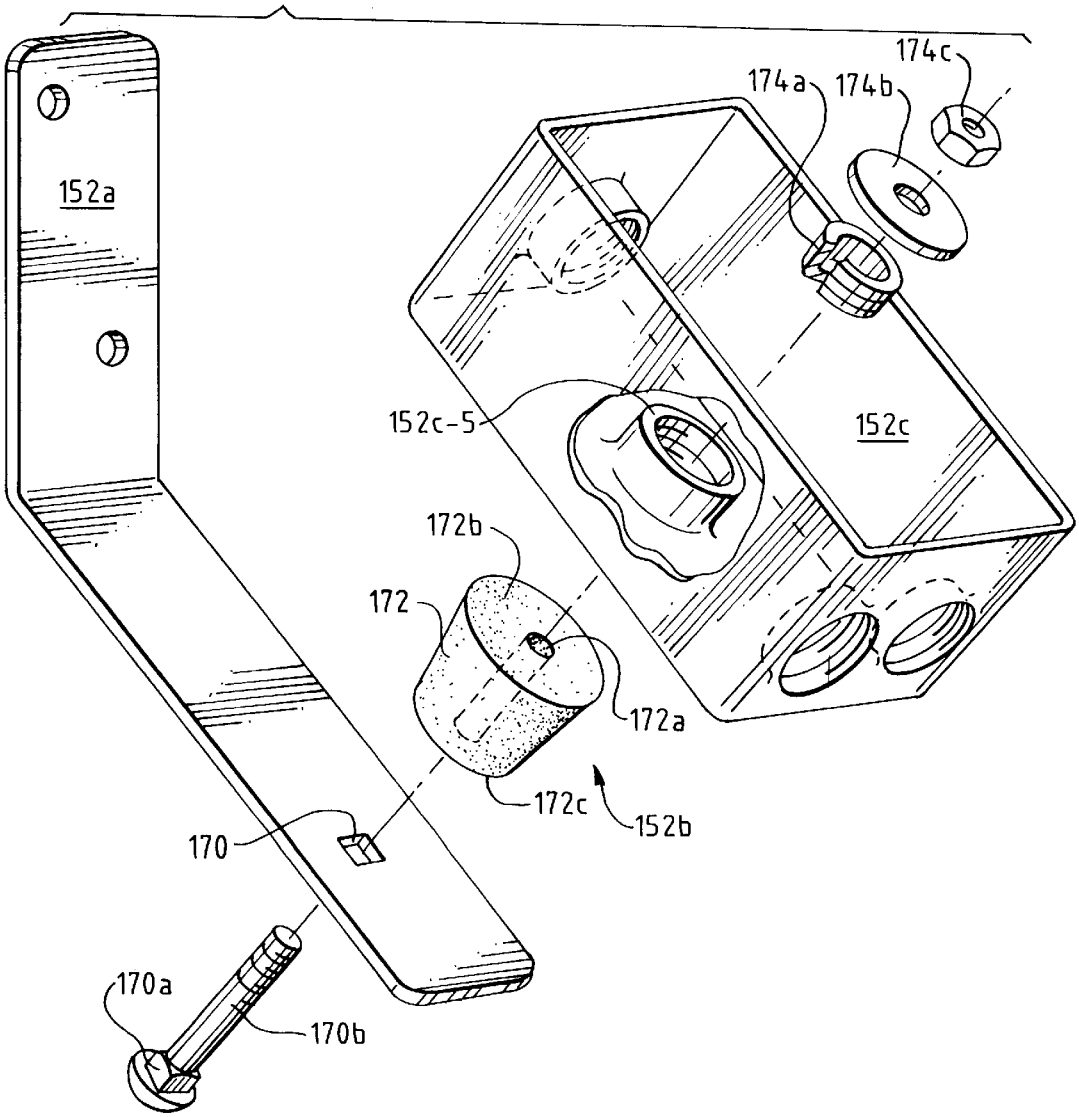
FIG. 15A is an exploded view of the device of FIG. 13.

FIG. 15A illustrates details of the resilient support 152*b*. The bracket 152*a* is formed with a square or rectangular opening 170. The opening 170 is sized to accept a square portion 170*a* of a carriage bolt of a conventional variety. The bolt has a threaded shaft 170*b*.

A tapered rubber bushing 172 formed with a central boring 172*a* therethrough is positioned between the bracket 152*a* and the housing 152*c*. The shaft 170*b* of the carriage bolt extends therethrough. The threaded end 170*b* extends into a threaded opening 152*c*-5 of the housing 152*c*.

A threaded bushing 174*a* is threaded into the opening 152*c*-5. A washer 174*b* is placed on the shaft 170*b*. A prevailing torque nut with a locking element 174*c* is threaded onto the shaft 170*b*.

The nut 174*c* is tightened to the appropriate torque thereby compressing the bushing 172. A face 172*b* of the bushing contacts with and seals the bottom panel 152*c*-1 of the housing 152*c*. The other face 172*c* is in contact with the bracket 152*a*.

The deformable support 152*b*, due to the elasticity of the bushing 172, permits the housing 152*c* to be adjusted in horizontal and vertical directions, best seen in FIG. 15. The pre-load established on the bushing 172 substantially retains the housing 152*c* in a preset orientation. In addition to providing a water and dust resistant seal, the bushing 172 isolates the housing 152*c* from vibration.

The round head of the carriage bolt, adjacent the square portion 170*a* of the shaft provides increased security in that it cannot be removed or loosened with a wrench. The presence of the shaft 170*b* extending through the bushing 172 further improves security by making it difficult to sever the joint.

Figure 16:
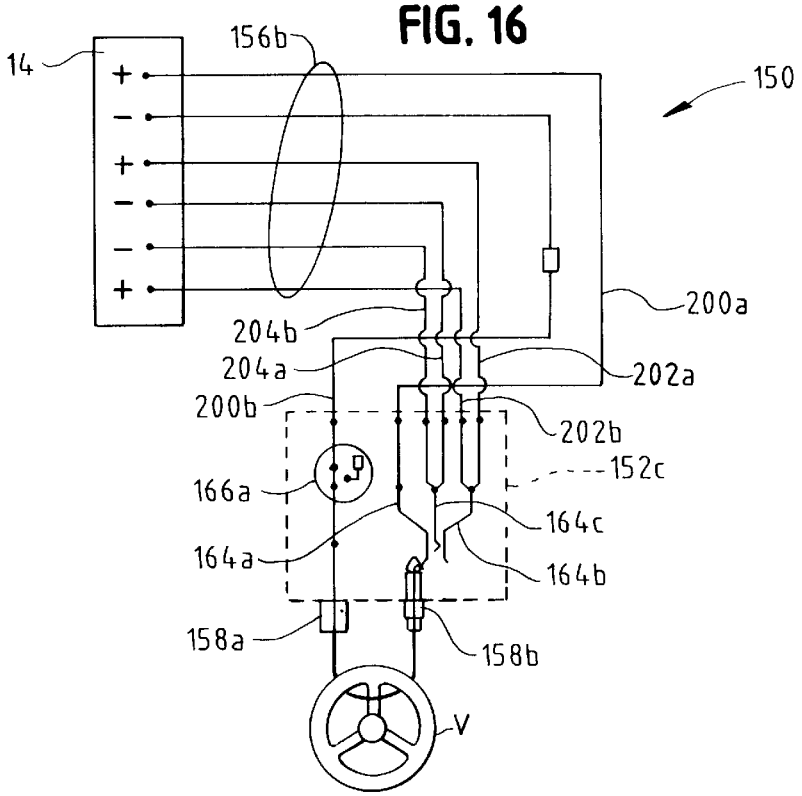
FIG. 16 is a schematic illustrating Class A-type wiring of a single device as in FIG. 13.

FIG. 16, an electrical schematic, illustrates the supervisory device 150 coupled to a valve handle V and also in turn coupled to control element 14 via multiconductor cable 156*b*. As illustrated in FIG. 16, with the plug 158*b* inserted into the housing 152*a*, an electrical path is formed, which could support a supervisory current flow, from conductor 200*a*, through contact 164*a*, plug 158*b*, cable 158*c*, connector 158*a* and conductor 200*b*.

As illustrated in FIG. 16, conductors 200*a* and *b* are part of the multiconductor cable 156*b*. In this state, the auxiliary contacts, or trouble contacts 164*b, c* are open circuited. Each of contacts 164*b, c* is coupled by first and second conductors 202*a, b* and 204*a, b* via cable 156*b* to control element 14.

When the plug 158*b* is pulled from the female connector or socket 158*d*, the supervisory circuit, conductor loop 200*a, b*, is open-circuited. The auxiliary or trouble circuit contact loop 164*b, c* is closed.

The conductive paths 202*a, b* and 204*a, b* each will support a trouble indicating current which enables control unit 14 to independently supervise each of those contacts independently of their closure state. Hence, due to the multiplicity of conductors, the control unit 14 is able to supervise both sides of the trouble loop independently. Further, if the cable 158*c* is cut, this condition can be recognized by the control element 14 in that a current flow failure occurs in loop 200*a, b*. However, the trouble loops 202*a, b* and 204*a, b* continue to support supervisory current flow.

Figure 17:
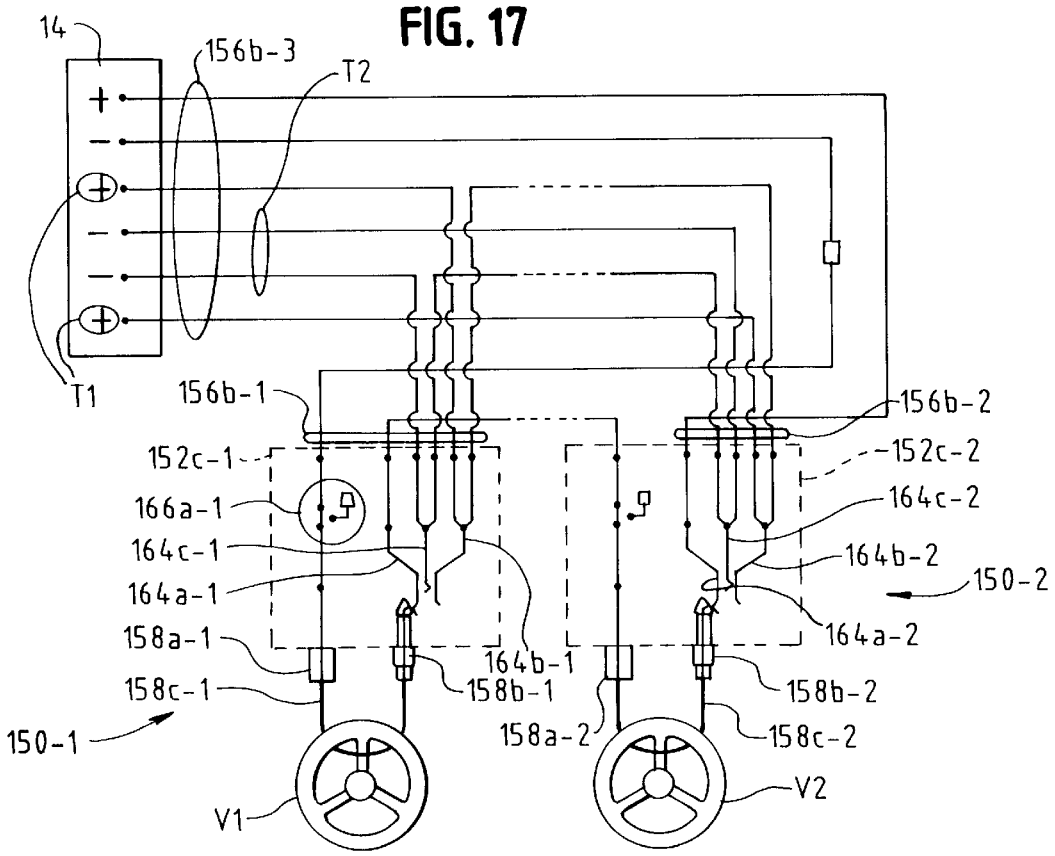
FIG. 17 is a schematic illustrating Class A-type wiring of two devices as in FIG. 13.

FIG. 17 illustrates interconnections of multiple supervisory devices 150-1 and 150-2 coupled respectively to valve handles V1 and V2. The supervisory devices 150-1 and 150-2 will support Class A-type wiring as described subsequently. The valve handle supervisory cables 158*c*-1, 158*c*-2 are connected in series, via multi-conductor cable 156*b*-3 to control unit 14. Hence, pulling plug 158*b*-1 or 158*b*-2 (due to moving respective valve handle V1, V2 for example) will interrupt a supervisory current flow. The same is true if one of the cables is cut.

Auxiliary or trouble contacts 164*b*-1, *c*-1 and 164*b*-2, *c*-2 are open circuited by the presence of a respective plug, 158*b*-1, *b*-2. Contacts 164*b*-1, *b*-2 are coupled in series in a trouble loop T1. Contacts 164*c*-1, *c*-2 are coupled in series in a trouble loop T2. The loops T1, T2 are coupled in parallel to the control unit 14.

As a result of loops T1, T2 control unit 14 can ascertain, for the valves V1, V2 if respective cable 158*c*-1, *c*-2 has been removed or cut. If removed, one of 164*b*-1, *c*-1 or 164*b*-2, *c*-2 will change state at the same time that a current loss is detected in supervisory loop 158*c*-1 or *c*-2. If a cable is cut, only the supervisory current is lost. Other types of electrical signaling can also be used.

It will be understood that the device 150 can be coupled to control unit 14 in other ways without departing from the spirit and scope of the present invention. For example, and without limitation, contacts 158*b*, 164*a*, 164*b* and 164*c* could be coupled in series in an alternate form of single device operation. In an alternate form of multiple device operation, contacts 164*b*-1, 164*b*-2, 164*a*-2, 158*b*-2, 164*a*-1,

**158*b*-1, 164*c*-1 and 164*c*-2** could be coupled in series. Other permutations are possible without departing from the spirit and scope hereof.

Although the present invention has been described in detail by way of illustration and example, it should be understood that a wide range of changes and modifications can be made to the preferred embodiments described above without departing in any way from the scope and spirit of the invention. Thus, the described embodiments are to be considered in all respects only as illustrative and not restrictive, and the scope of the invention is, therefore, indicated by the appended claims rather than the foregoing description. All changes that come within the meaning and range of equivalency of the claims are to be embraced within their scope.

What is claimed:

1. An apparatus for monitoring the location of a selected member to which a monitoring element is attached, the apparatus comprising:

a housing;

a first connecting element carried by the housing;

a rotary blocking member, carried by the housing, and having a blocking position that blocks access to the connecting element wherein when the monitoring element, coupled to the first connecting element, is uncoupled therefrom in response to movement of the selected member from a first location, the blocking member moves to the blocking position interposed between the monitoring element and the first connecting element whereupon the monitoring element cannot be recoupled to the connecting element.

2. An apparatus as in claim 1 which includes a biasing element wherein the blocking member is biased toward the blocking position.

3. An apparatus as in claim 2 wherein the biasing element includes a metallic spring.

4. An apparatus as in claim 2 wherein the first connecting element is rigidly attached to the housing.

5. An apparatus as in claim 1 wherein the housing is sealed and is substantially moisture resistant.

6. An apparatus as in claim 1 wherein the housing has a removable cover and wherein the housing carries a cover position sensor.

7. An apparatus as in claim 6 wherein the cover position sensor comprises a multi-state switch.

8. An apparatus as in claim 1 which includes a mounting bracket and a resilient coupling element for attaching the bracket to the housing.

9. An apparatus as in claim 8 wherein the coupling element includes a tapered, deformable member positioned between the bracket and the housing.

10. An apparatus as in claim 1 wherein the first connecting element has first and second contacts wherein the contacts are opened by coupling the monitoring element thereto.

11. An apparatus as in claim 10 wherein the first connecting element has a portion in electrical contact with the monitoring element simultaneously when the first and second contacts are open.

12. An apparatus as in claim 11 which incudes a separate pair of conductors coupled to each of the first and second contacts whereby current can be passed through each of the first and second contacts irrespective of their closure state.

13. An apparatus as in claim 11 wherein removal of the monitoring element permits the first and second contacts to close simultaneously while breaking the electrical contact between the portion and the first connection.

14. An apparatus as in claim 10 wherein the monitoring element comprises a flexible conductive member.

15. An apparatus as in claim 1 wherein said blocking member is contained within said housing.

16. First and second supervisory devices for monitoring the location of a selected member to which a monitoring element is attached, each supervisory device comprising:

a housing;

a first connecting element carried by the housing wherein the connecting element carries separable first and second contacts;

a blocking member, carried by the housing, and having a blocking position that blocks access to the connecting element wherein when the monitoring element, coupled to the first connecting element, is uncoupled therefrom in response to movement of the selected member from a first location, the blocking member moves to the blocking position whereupon the monitoring element can not be recoupled to the connecting element;

wherein the first contacts are coupled together in series so as to couple an electrical signal therethrough and wherein the second contacts are coupled together in series so as to couple another electrical signal therethrough.

17. First and second devices as in claim 16 wherein a respective monitoring element is coupled to a respective selected member wherein the monitoring elements are connected in series.

18. First and second devices as in claim 16 wherein the blocking member of each device is mounted for rotary movement.

19. First and second devices as in claim 16 wherein at least one of the electrical signals corresponds to a current flow.

20. First and second devices as in claim 16 wherein respective first and second contacts are part of a respective monitoring loop.

21. First and second devices as in claim 15 wherein said blocking member is contained within said housing.

22. An apparatus for monitoring the location of a selected member, the apparatus comprising:

a housing;

a first connecting element carried by the housing;

a flexible, elongated monitoring element to be attached to the member and coupled to the connecting element;

a rotary blocking member, carried by the housing, and having a blocking position that blocks access to the connecting element wherein when the monitoring element is uncoupled therefrom in response to movement of the selected member from a first location, the blocking member moves to the blocking position interposed between the monitoring element and the first connecting element whereupon the monitoring element cannot be recoupled to the connecting element.

23. An apparatus as in claim 22 which includes a metallic biasing element wherein the blocking member is biased toward the blocking position.

24. An apparatus as in claim 22 wherein the first connecting element is rigidly attached to the housing.

25. An apparatus as in claim 22 wherein the housing is sealed and is substantially moisture resistant.

26. An apparatus as in claim 22 wherein the housing has a removable cover and wherein the housing carries a cover position sensor.

27. An apparatus as in claim 22 wherein the monitoring element has first and second ends, wherein one end is fixedly attached to the housing and the other end is removably coupled to the connecting element.

28. An apparatus as in claim 27 wherein the monitoring element includes at least one conductor which extends between the ends.

29. An apparatus as in claim 28 which includes at least first and second contacts carried on the connecting element.

30. An apparatus as in claim 22 wherein the monitoring element includes a conductor.

31. An apparatus as in claim 22 which incudes a mounting bracket and a resilient, tapered, coupling element for attaching the bracket to the housing.

32. An apparatus as in claim 22 wherein the first connecting element has first and second multi-state contacts wherein the contacts change state in response to coupling the monitoring element thereto.

33. An apparatus as in claim 32 wherein the first connecting element carries at least a third contact wherein the third contact engages the monitoring element simultaneously when the first and second contacts change state.

34. An apparatus as in claim 22 which includes a separate pair of conductors coupled to each of the first and second contacts whereby current can be passed through each of the first and second contacts irrespective of their state.

35. An apparatus as in claim 22 wherein said blocking member is contained within said housing.

36. An apparatus for monitoring the location of a selected member to which is attached a monitoring element, the apparatus comprising:

a housing;

a connector carried, at least in part, within the housing wherein the connector defines a coupling port for slidably and removably receiving a selected part of the monitoring element;

a blocking element carried within the housing and biased toward a blocking position wherein the selected part of the monitoring element, when inserted to a first location in the coupling port, inhibits movement of the blocking element to the blocking position and wherein when the selected part is moved from the first location to a displaced second location, the blocking element moves to the blocking position whereby the selected part is blocked from the first position.

37. An apparatus as in claim 36 wherein the connector carries at least one conductor in the housing for engagement with the selected part to form a conductive path and wherein disengagement of the conductor from the selected part breaks the conductive path.

38. An apparatus as in claim 36 wherein said blocking element is rotatably mounted within said housing and said movement of the blocking element is a rotational movement.

39. A method of supervising the location of an object comprising:

establishing a first location for the object;

coupling a monitoring element to the object;

moving a blocking member to a second location;

positioning a portion of the monitoring element to a monitoring position at a third location, adjacent to a selected part of the blocking member thereby indicating that the object is at the first location;

detecting movement of the portion of the monitoring element a preselected distance away from the third location;

moving the blocking element, in response to the detected movement, from the second location to a blocking location thereby inhibiting return movement of the portion of the monitoring element to the third location.

40. A method as in claim 39 wherein the movement comprises rotary movement.

41. A method as in claim 39 which includes providing a substantially closed region and positioning the blocking member therein.

42. A method as in claim 39 which includes applying a force to the blocking member to bias it to the second location.

43. A method as in claim 42 wherein the force causes rotation of the blocking member.

* * * * *